US008734191B2

(12) United States Patent
Zhao

(10) Patent No.: US 8,734,191 B2
(45) Date of Patent: May 27, 2014

(54) POWER CONNECTOR SYSTEM

(75) Inventor: Weiping Zhao, Superior Township, MI (US)

(73) Assignee: Tyco Electronics Corporation, Berwyn, PA (US)

( * ) Notice: Subject to any disclaimer, the term of this patent is extended or adjusted under 35 U.S.C. 154(b) by 194 days.

(21) Appl. No.: 13/267,600

(22) Filed: Oct. 6, 2011

(65) Prior Publication Data

US 2013/0090009 A1 Apr. 11, 2013

(51) Int. Cl.
*H01R 13/502* (2006.01)

(52) U.S. Cl.
USPC ..... 439/701; 439/500

(58) Field of Classification Search
USPC ..... 439/500, 701
See application file for complete search history.

(56) References Cited

U.S. PATENT DOCUMENTS

| | | | | |
|---|---|---|---|---|
| 4,042,759 | A | 8/1977 | Cella | |
| 4,830,624 | A | 5/1989 | Rose et al. | |
| 5,424,714 | A * | 6/1995 | Kin et al. | 340/438 |
| 6,067,808 | A * | 5/2000 | Dage | 62/150 |
| 6,281,649 | B1 * | 8/2001 | Ouellette et al. | 318/443 |
| 6,402,565 | B1 * | 6/2002 | Pooley et al. | 439/680 |
| 7,294,020 | B2 | 11/2007 | Zhao et al. | |
| 7,549,889 | B2 | 6/2009 | Sikora | |
| 2004/0008000 | A1 * | 1/2004 | Merkel et al. | 318/444 |
| 2006/0006826 | A1 * | 1/2006 | Morishita | 318/483 |

OTHER PUBLICATIONS

Kostal; Automobile connectors for high voltage (HV) applications; 5 pg.s.

* cited by examiner

*Primary Examiner* — Truc Nguyen

(57) ABSTRACT

A touch safe right angle power connector includes a header assembly that includes a conductive pin, an inner shroud that surrounds the pin, and an outer shroud that surrounds the inner shroud. The inner shroud has slots therethrough. The power connector includes a power terminal connector having a plug housing that has a cavity and an insert assembly that is received in the cavity. The insert assembly has a terminal body configured to be terminated to an end of a conductor of a power cable and is electrically connected to the pin of the header assembly. The insert assembly has a dielectric insert that holds the terminal body. The insert assembly has a shield that surrounds the dielectric insert and provides shielding for the terminal body. The plug housing has optional ribs which are received in corresponding slots to orient the power terminal with respect to the header assembly.

20 Claims, 4 Drawing Sheets

POWER CONNECTOR SYSTEM

BACKGROUND OF THE INVENTION

The subject matter herein relates generally to connector systems having power terminal connectors.

Power terminal connectors are used in different types of connector systems. One application is an automotive application, such as for connection to a battery of a vehicle. In some applications, spacing around the battery, such as above the battery, in front of the battery, to one side or the other of the battery, may be limited. There may not be room for a power terminal connector to extend into such space, or there may not be room around the battery to get a tool for connecting and un-connecting the power terminal connector to the power terminal of the battery. Additionally, connecting and un-connecting the power terminal connector to the power terminal of the battery may be time consuming or require special, expensive tools.

Some applications require touch safe connectors on both the header and plug sides of the power terminal connector to protect against inadvertent touching of the power carrying components of the power terminal connector. Touch safe tests are performed on the power terminal connectors to ensure compliance with safety regulations. The touch safe tests use a test tool to test compliance, which requires that the tool, which has certain dimensions, such as dimensions similar to a human finger, is incapable of touching the current carrying components of the power terminal connector. Current designs of such touch safe power terminal connectors are complex in design and have numerous components. The overall size of the touch safe power terminal connectors is big and are not robust.

A need remains for a touch safe power terminal connector that may be connected to a power terminal in an efficient manner. A need remains for a touch safe header assembly and touch safe power terminal connector with reduced part count, simple design, small size and/or robust design.

BRIEF DESCRIPTION OF THE INVENTION

In one embodiment, a touch safe right angle power connector is provided having a header assembly that includes a conductive pin, an inner shroud surrounding the pin, and an outer shroud surrounding the inner shroud. The inner shroud has slots therethrough. The power connector includes a power terminal connector having a plug housing that has a cavity and an insert assembly received in the cavity. The insert assembly has a terminal body configured to be terminated to an end of a conductor of a power cable and is electrically connected to the pin of the header assembly. The insert assembly has a dielectric insert that holds the terminal body. The insert assembly has a shield that surrounds the dielectric insert and provides shielding for the terminal body. The plug housing has ribs configured to be received in corresponding slots to orient the power terminal with respect to the header assembly.

In another embodiment, a touch safe right angle power connector is provided having a header assembly that includes a conductive pin, an inner shroud that surrounds the pin, and an outer shroud that surrounds the inner shroud. The inner shroud has slots therethrough. The power connector includes a power terminal connector having a plug housing that has a cavity and an insert assembly that is received in the cavity. The plug housing has ribs configured to be received in corresponding slots to orient the power terminal with respect to the header assembly. An insert assembly is received in the cavity.

The insert assembly has a terminal body configured to be terminated to an end of a conductor of a power cable and is electrically connected to the pin of the header assembly. The insert assembly has a dielectric insert that holds the terminal body. The insert assembly has a shield that surrounds the dielectric insert and provides shielding for the terminal body. The dielectric insert has an upper plug insert and a lower plug insert coupled to the upper plug insert. The terminal body is captured between the upper and lower plug inserts.

In a further embodiment, a touch safe right angle power connector is provided having a power terminal connector configured to be electrically connected to a header assembly. The power terminal connector includes a plug housing that has a cavity and an insert assembly that is received in the cavity. The insert assembly has a terminal body configured to be terminated to an end of a conductor of a power cable and configured to be electrically connected to the pin of the header assembly. The insert assembly has a dielectric insert that holds the terminal body. The insert assembly has a shield that surrounds the dielectric insert and provides shielding for the terminal body. The dielectric insert has an upper plug insert and a lower plug insert coupled to the upper plug insert. The terminal body is captured between the upper and lower plug inserts.

DETAILED DESCRIPTION OF THE INVENTION

Figure 1:
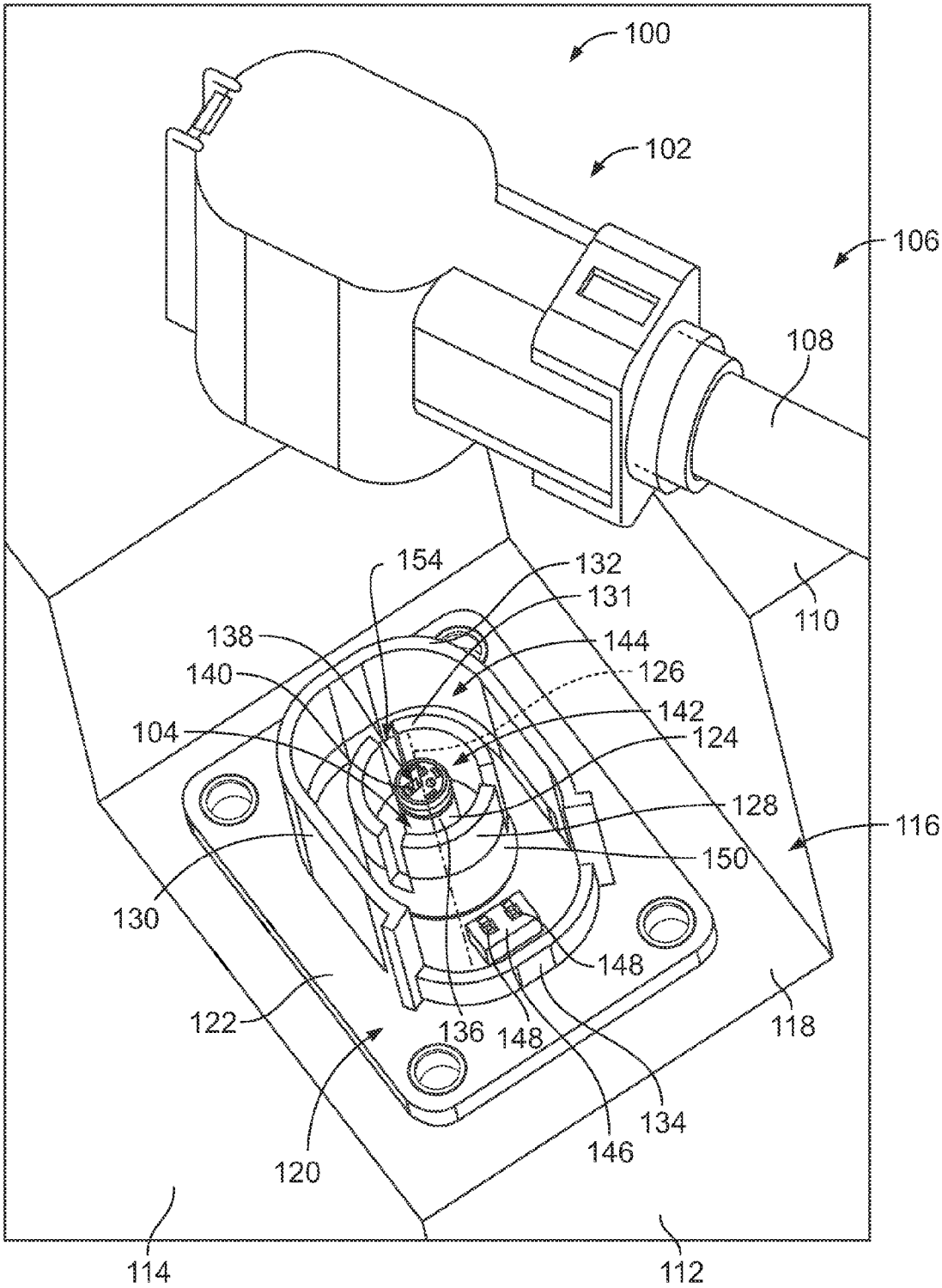
FIG. 1 illustrates a connector system formed in accordance with an exemplary embodiment.

FIG. 1 illustrates a power connector system 100 formed in accordance with an exemplary embodiment. The power connector system 100 includes a power terminal connector 102 that is configured to be terminated to a power terminal 104 of a component, such as a battery 106. The power terminal connector 102 is terminated to an end of a cable 108. The battery 106 may be any voltage battery used in a vehicle. Optionally, the vehicle may be an electrical or hybrid electric vehicle and the battery 106 may be used as part of the power system for the electric vehicle or hybrid electrical vehicle.

The power terminal connector 102 is a quick connect/quick disconnect type of connector that may be easily and quickly terminated to the power terminal 104. The power terminal connector 102 has a very low profile so as to conserve space around the battery 106.

The battery 106 includes a top 110, a front 112 perpendicular to the top 110, and a side 114 perpendicular to the top 110 and the front 112. The top 110, front 112 and side 114 generally meet at a corner of the battery 106. In an exemplary embodiment, the battery 106 includes a notched-out area 116 at the corner. The notched-out area 116 is recessed below the top 110, behind the front 112, and inward from the side 114. The notched-out area 116 defines a window or envelope defined by planes extending along the top 110, front 112 and side 114.

The power terminal 104 and power terminal connector 102 are positioned within the notched-out area 116. The battery 106 includes a mounting pad 118 at the bottom of the notched-out area 116. The power terminal 104 extends from the mounting pad 118. A header assembly 120 is coupled to the mounting pad 118. The power terminal connector 102 is configured to be coupled to the header assembly 120. In an exemplary embodiment, the header assembly 120 is received in the notched-out area 116 such that the header assembly 120 does not extend beyond the top 110, the front 112 or the side 114. The power terminal connector 102 is coupled to the power terminal 104 and the header assembly 120 such that the power terminal connector 102 does not extend beyond (e.g., above) the top 110. The power terminal connector 102 is coupled to the power terminal 104 and the header assembly 120 such that the power terminal connector 102 does not extend beyond (e.g., outward from) the side 114. A portion of the power terminal connector 102 and/or the cable 108 extends from the front 112. As such, other components, such as another battery may be positioned immediately adjacent the side 114 without interference from the header assembly 120 or the power terminal connector 102. Another component, such as a cover or lid may extend along the top 110 without interference from the header assembly 120 or the power terminal connector 102.

In an alternative embodiment, rather than having the cable 108 and the power terminal connector 102 extending from the front 112, the cable 108 and the power terminal connector 102 may extend from the side 114. In such embodiment, the power terminal connector 102 may not extend beyond the (e.g., forward of) the front 112. In other alternative embodiments, the power terminal connector 102 may be coupled to a battery or other component that is not recessed.

In an exemplary embodiment, the header assembly 120 is a fixed connector of the battery 106 providing an interface for the power terminal connector 102. The header assembly 120 includes the power terminal 104. The header assembly 120 includes a base 122 for mounting the header assembly 120 to the mounting pad 118.

The power terminal 104 includes a conductive pin 124 extending from, and electrically coupled to, the battery 106. The pin 124 extends through the base 122. The pin 124 extends along a pin axis 126 that is generally parallel to the front 112 and the side 114.

The header assembly 120 includes an inner shroud 128 and an outer shroud 130. The inner shroud 128 surrounds the pin 124. The outer shroud 130 surrounds the inner shroud 128. In an exemplary embodiment, the inner shroud 128 is cylindrical in shape and the outer shroud 130 is oval shaped. The inner and outer shrouds 128, 130 have open tops 131, 132, respectively. The outer shroud 130 has an open side 134. In an exemplary embodiment, the inner and outer shrouds 128, 130 are non-conductive and protect against inadvertent touching of the power terminal 104. In an exemplary embodiment, the inner shroud 128, outer shroud 130 and base 122 are co-molded and integrally formed. The pin 124 extends axially upward from the base 122. The inner shroud 128 and outer shroud 130 are positioned radially outward from the pin 124.

During assembly, the power terminal connector 102 is loaded onto the header assembly 120 from above in a direction along the pin axis 126. Portions of the power terminal connector 102 are received between the pin 124 and the inner shroud 128. Portions of the power terminal connector 102 are received between the inner shroud 128 and the outer shroud 130. Portions of the power terminal connector 102 surround the outer shroud 130. When the power terminal connector 102 is connected to the power terminal 104, a portion of the terminal power connector 102 extends through the open side 134. In an exemplary embodiment, the power terminal connector 102 includes a latch 224 (shown in FIG. 3) to secure the power terminal connector 102 to the header assembly 120 such that the power terminal connector 102 cannot be inadvertently released from the power terminal 104. Rather, a deliberate action is taken to release the power terminal connector 102, after which the power terminal connector 102 may be lifted off the pin 124 in a direction parallel to the pin axis 126.

The pin 124 includes an outer contact surface 136. The pin 124 extends to a distal end 138. In an exemplary embodiment, an insulative cap 140 is provided at the distal end 138. The insulative cap 140 is non-conductive and protects against inadvertent touching of the pin 124 to make the pin touch safe.

In an exemplary embodiment, an inner gap 142 is defined between the pin 124 and the inner shroud 128. The inner gap 142 is narrow enough to pass a touch safe test. For example, a test tool cannot fit in the inner gap 142 under specified force because the spacing between the pin 124 and the inner shroud 128 is too small to receive the test tool and strong enough to withstand the specified force. The inner shroud 128 blocks or restricts access to the conductive outer contact surface 136 of the pin 124 to make the header assembly 120 touch safe.

In an exemplary embodiment, an outer gap 144 is defined between the inner shroud 128 and the outer shroud 130. The outer gap 144 is configured to receive a portion of the power terminal connector 102. In an exemplary embodiment, a high voltage interlock (HVIL) connector 146 is provided in the outer gap 144 between the outer shroud 130 and the inner shroud 128. Power is restricted from flowing through the power terminal 104 until an HVIL circuit is complete, which occurs after the power terminal connector 102 is fully connected to the power terminal 104. The HVIL connector 146 is a safety feature of the power connector system 100. In an exemplary embodiment, the HVIL connector 146 includes two HVIL contacts 148 that must be electrically connected to close the HVIL circuit. The HVIL contacts 148 are electrically connected after the power terminal connector 102 is coupled to the power terminal 104. The HVIL connector 146 may be located in other locations in alternative embodiments.

The header assembly 120 includes a shroud shield 150 providing shielding around the inner shroud 128. The shroud shield 150 circumferentially surrounds an outer surface of the inner shroud 128. The shroud shield 150 may provide shielding from electro-magnetic interference (EMI). The shroud shield 150 may provide electro-magnetic compatibility (EMC) for the power connector system 100. The shroud shield 150 is a conductive shield, such as a metal shield. The shroud shield 150 may be stamped and formed. The shroud shield 150 may extend at least partially through the base 122. The shroud shield 150 may be electrically connected to a grounded component of the battery 106. The shroud shield 150 is positioned between the inner shroud 128 and the HVIL connector 146. The shroud shield 150 provides shielding between the HVIL connector 146 and the pin 124. The inner shroud 128 is positioned between the shroud shield 150 and the pin 124 to ensure that a dielectric material separates the pin 124 from the shroud shield 150. The inner shroud 128 prevents inadvertent contact between the shroud shield 150 and the pin 124. In an exemplary embodiment, the inner shroud 128 extends further from the base 122 than the shroud shield 150.

The inner shroud 128 extends to the top 131 from the base 122. The inner shroud 128 extends along the pin axis 126. The inner shroud 128 is cylindrical in shape. In an exemplary embodiment, the inner shroud 128 includes a plurality of slots 154 formed therein. The slots 154 are open at the top 131 and extend downward along the inner shroud 128 at least partially between the top 131 and the base 122. The slots 154 are relatively narrow and are narrower than the test tool and strong enough to ensure that the test tool is incapable of being passed through one of the slots 154 to touch the pin 124. The slots 154 are used for accepting ribs 254 (shown in FIG. 4) in the power terminal connector 102 to orient the power terminal connector 102 with respect to the header assembly 120. The slots 154 and ribs 254 are optional. Other types of orientation features may be used in alternative embodiments. In an exemplary embodiment, the top 131 is generally coplanar with the distal end 138 of the pin 124. The insulative cap 140 is generally aligned with the top 131. As such, the inner shroud 128 extends along the pin axis 126 from the base 122 for the entire height of the pin 124. The inner shroud 128 blocks access to the entire pin 124 to define a touch safe power connector.

Figure 2:
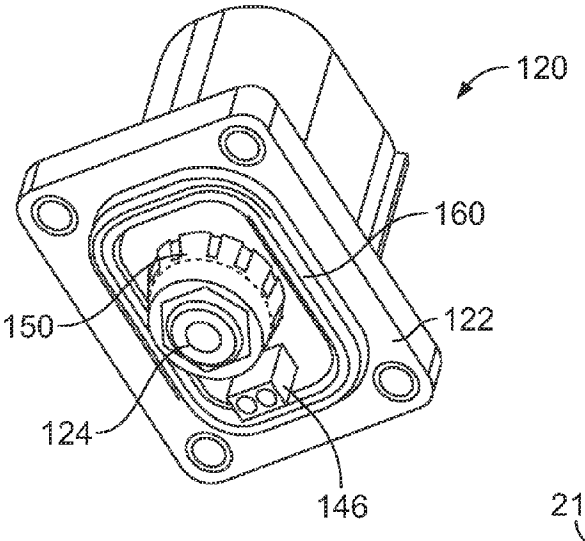
FIG. 2 is a bottom perspective view of a header assembly shown in FIG. 1.

FIG. 2 is a bottom perspective view of the header assembly 120. The pin 124 is illustrated in FIG. 2 as being provided at the bottom of the header assembly 120. The pin 124 is configured to be electrically connected to the battery 106 (shown in FIG. 1) at the bottom of the header assembly 120. The HVIL connector 146 is provided at the bottom of the header assembly 120. The HVIL connector 146 may be connected to other components of the HVIL circuit within the battery 106.

A header seal 160 is provided on the bottom of the base 122. The header seal 160 may seal the header assembly 120 to the battery 106. The header seal 160 may be a gasket. Alternatively, the header seal 160 may be a sealant applied to the bottom of the base 122.

The shroud shield 150 extends through the base 122 and is exposed below the base 122. The shroud shield 150 may be electrically connected to a grounded component of the battery 106 below the base 122.

Figure 3:
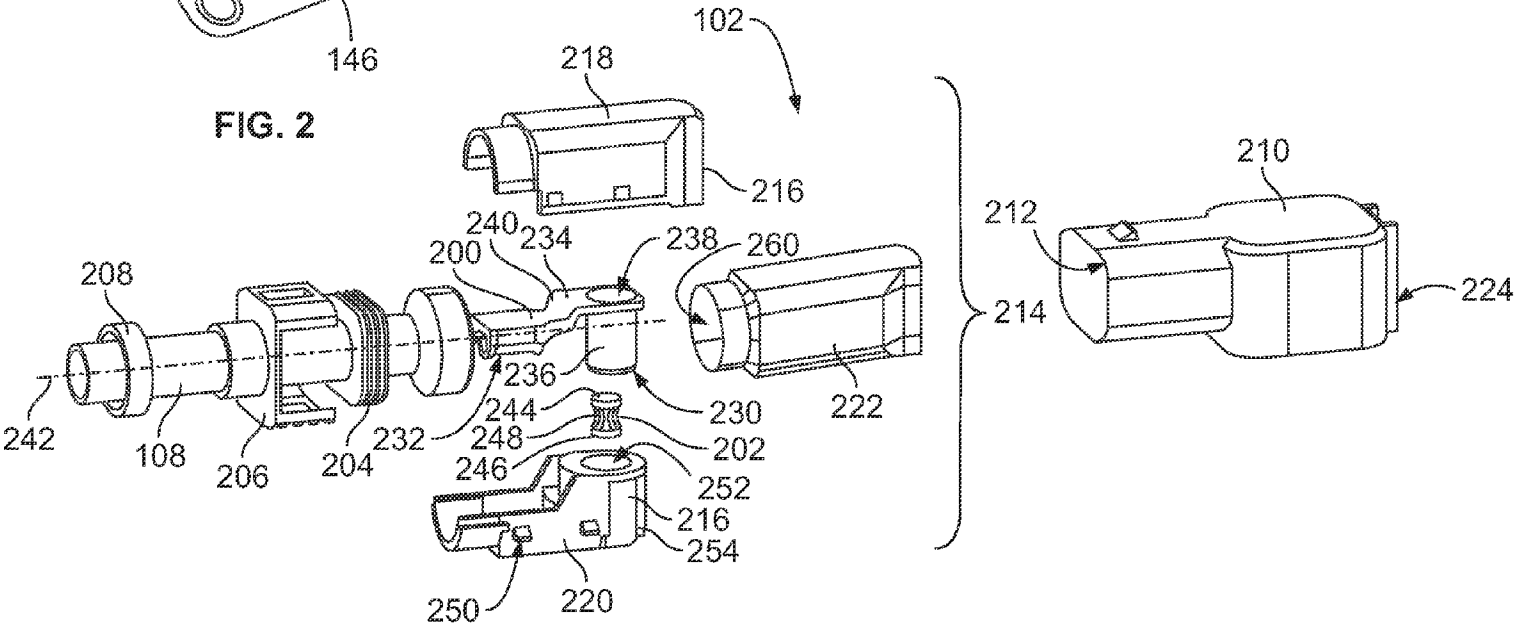
FIG. 3 is an exploded view of a power terminal connector shown in FIG. 1.

FIG. 3 is an exploded view of the power terminal connector 102. The power terminal connector 102 includes a terminal body 200 that is configured to be electrically connected to the power terminal 104 (shown in FIG. 1). The terminal body 200 is configured to be terminated to the end of the cable 108. The power terminal connector 102 includes a contact spring 202 that is received in the terminal body 200. The contact spring 202 is used to electrically connect the terminal body 200 to the pin 124 (shown in FIG. 1).

The terminal body 200 is configured to be terminated to a central conductor of the cable 108. A cable seal 204 is provided around the cable 108. A cable retainer 206 is fed onto the end of the cable 108 along with a retainer ring 208 that is used to secure the cable retainer 206 to the cable 108. The cable seal 204 provides sealing between the cable 108 and the power terminal connector 102. The cable retainer 206 is used to secure the power terminal connector 102 to the cable 108. The cable retainer 206 may provide strain relief between the power terminal connector 102 and the cable 108.

The power terminal connector 102 includes a plug housing 210 having a cavity 212 and an insert assembly 214 that is configured to be received in the cavity 212. The insert assembly 214 includes the terminal body 200 and the contact spring 202. The insert assembly 214 includes a dielectric insert 216 that holds the terminal body 200. In an exemplary embodiment, the dielectric insert 216 includes an upper plug insert 218 and a lower plug insert 220 that are coupled together and hold the terminal body 200 therebetween. The insert assembly 214 has an insert shield 222 surrounding the dielectric insert 216 and providing shielding for the terminal body 200. Optionally, the insert shield 222 may be a stamped and formed part that may be assembled around the dielectric insert 216. In an exemplary embodiment, the insert shield 222 is configured to be electrically connected to a shield of the cable 108. The insert shield 222 is configured to be electrically connected to the shroud shield 150 (shown in FIG. 1) when the power terminal connector 102 is coupled to the header assembly 120.

The plug housing 210 surrounds the insert assembly 214, including the terminal body 200 and the insert shield 222, protecting the terminal body 200 and insert shield 222 from inadvertent touching by a person or a tool, which could cause electrical shock that could injure the person or the power terminal connector 102. The plug housing 210 extends along a portion of the cable 108 to cover the termination between the shield of the cable 108 and a ferrule 300 (shown in FIG. 5) on the cable. The plug housing 210 is configured to be coupled to the cable retainer 206 to secure the plug housing 210 to the cable 108. The cable seal 204 is positioned inside the plug housing 210 and may seal to the plug housing 210. In an exemplary embodiment, the plug housing 210 includes a latch 224 that is used to secure the power terminal connector 102 to the header assembly 120.

The terminal body 200 extends between a mating end 230 and a mounting end 232. The mounting end 232 is configured to be terminated to the cable 108. In an exemplary embodiment, the mounting end 232 includes a crimp ferrule that may be crimped to the cable 108. The mounting end 232 may be terminated to the cable 108 by other means in alternative embodiments, such as soldering to the end of the cable 108. The terminal body 200 includes a base 234 extending between the mating end 230 and the mounting end 232.

At the mounting end 232, the terminal body 200 includes a socket 236 extending from the base 234. In an exemplary embodiment, the socket 236 includes a hollow chamber 238. Optionally, the chamber 238 may be open at both ends thereof for receiving the pin 124 through the bottom end of the socket 236. The contact spring 202 may also be loaded into the chamber 238 through either the open top or the open bottom of the socket 236. In an exemplary embodiment, the outer surface of the socket 236, as well as the inner surface defining the chamber 238 are generally cylindrical in shape. Other shapes are possible in alternative embodiments. In an exemplary embodiment, the mounting end 232 extends generally perpendicular with respect to the mating end 230. The mating end 230 is cylindrical and receives the pin 124 therein. The contact spring 202 is disposed in the mating end 230 to engage the pin 124 and the terminal body 200.

In an exemplary embodiment, the base 234 includes a jogged section or stepped section 240 that elevates the base 234 out of plane with respect to the crimp ferrule. The jogged section 240 changes the position of the socket 236 with respect to the cable 108. In an exemplary embodiment, a center of the socket 236 is approximately axially aligned with a central axis 242 of the conductor of the cable 108. The terminal body 200 is positioned and shaped to receive the contact spring 202 such that the interface between the contact spring 202 and the pin 124 is approximately axially aligned with the central axis 242 of the conductor. By controlling the position of the interface between the contact spring 202 and the pin 124, the overall height of the power terminal connector 102 may be controlled, and may be minimized to keep a low profile for the power terminal connector 102.

The contact spring 202 extends between a first end 244 and a second end 246. The contact spring 202 has a circumferential band at the first end 244 and another circumferential band at the second end 246. A plurality of spring beams 248 extend between the circumferential bands at the first and second ends 244, 246. In the illustrated embodiment, the spring beams 248 are inwardly tapered toward the middle of the contact spring 202. The contact spring 202 is necked-down at the middle of the contact spring 202. The contact spring 202 has a smaller diameter at the middle of the contact spring 202 and a larger diameter at the first and second ends 244, 246. The necked-down portion of the contact spring 202 is configured to engage the pin 124. The first and second ends 244, 246 are configured to engage the socket 236 when the contact spring 202 is loaded into the chamber 238. In an exemplary embodiment, the spring beams 248 are deflectable and may be deflected outward when the pin 124 is loaded into the contact spring 202. The contact spring 202 defines an electrical path between the pin 124 and the terminal body 200.

The upper and lower plug inserts 218, 220 are configured to encase the terminal body 200 to electrically isolate the terminal body 200 from the insert shield 222. The upper and lower plug inserts 218, 220 may be snapped together using latches 250. Other types of fastening means may be used in alternative embodiments. At a front end of the lower plug insert 220, an opening 252 is provided that receives the socket 236 at the mating end 230 of the terminal body 200. The opening 252 may be open through the lower plug insert 220 to receive the pin 124 through the bottom and the socket 236 through the top. In an exemplary embodiment, at the front of the lower plug insert 220, a plurality of ribs 254 are provided. The ribs 254 are configured to be received in corresponding slots 154 (shown in FIG. 1) of the inner shroud 128 (shown in FIG. 1). The ribs 254 maintain the space between the upper plug insert 218 and the lower plug insert 220. The slots 154 accept the ribs 254 to orient and/or resist movement between the power terminal connector 102 and the header assembly 120. Other types of orientation features may be used in alternative embodiments.

The insert shield 222 is shaped to surround the dielectric insert 216. The insert shield 222 includes an opening 260 at a rear of the insert shield 222, through which the cable 108 extends. The rear of the insert shield 220 is configured to be mated with a ferrule 300 (shown in FIG. 5). The ferrule 300 is terminated to a corresponding cable shield of the cable 108 to electrically common the insert shield 222 with respect to the cable shield. In an exemplary embodiment, the insert shield 222 includes an opening (not shown) in the bottom of the insert shield 222 to allow the pin 124 to be passed through the insert shield 222 for mating with terminal body 200.

Figure 4:
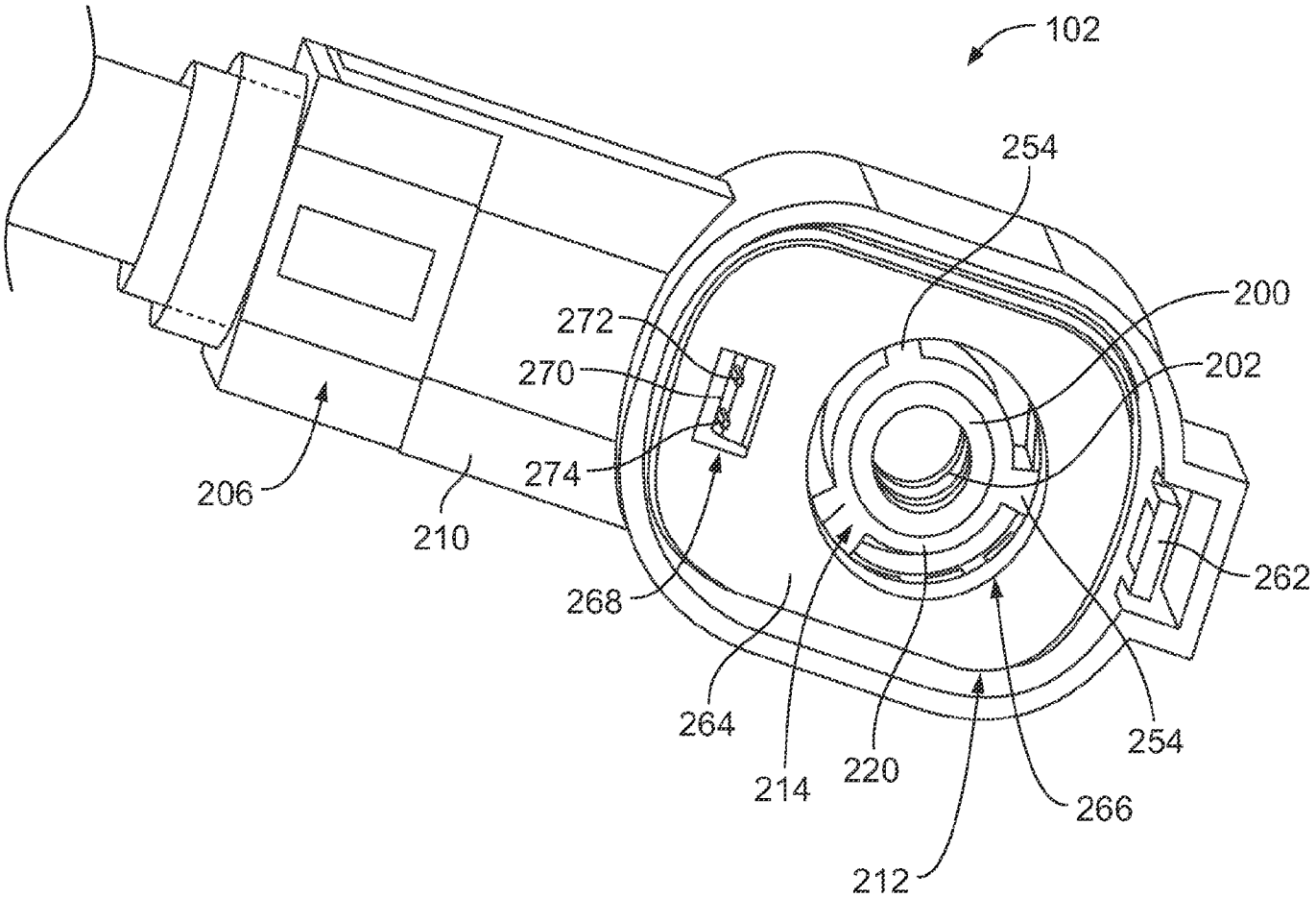
FIG. 4 is a bottom perspective view of a power terminal connector in an assembled state.

FIG. 4 is a bottom perspective view of the power terminal connector 102 in an assembled state. During assembly, the plug housing 210 is coupled to the cable retainer 206 using a latch 262. The insert assembly 214 is located in the cavity 212 of the plug housing 210. A cover 264 is coupled to the bottom of the plug housing 210 to cover the insert assembly 214. The cover 264 includes a first opening 266 that provides access to the terminal body 200 and the contact spring 202. The cover 264 includes a second opening 268 that provides access to a HVIL connector 270 of the power terminal connector 102. In an exemplary embodiment, the HVIL connector 270 includes first and second bussed pins 272, 274 that are electrically connected together or bussed together. The pins 272, 274 are configured to be electrically connected to corresponding HVIL contacts 148 (shown in FIG. 1) of the header assembly 120 (shown in FIG. 1). The pins 272, 274 electrically connect to corresponding HVIL contacts 148 to complete the HVIL circuit when the power terminal connector 102 is coupled to the header assembly 120.

The ribs 254 of the lower plug insert 220 are exposed in the first opening 266. When the power terminal connector 102 is coupled to the header assembly 120 the ribs 254 are received in corresponding slots 154 (shown in FIG. 1) of the inner shroud 128 (shown in FIG. 1).

Figure 5:
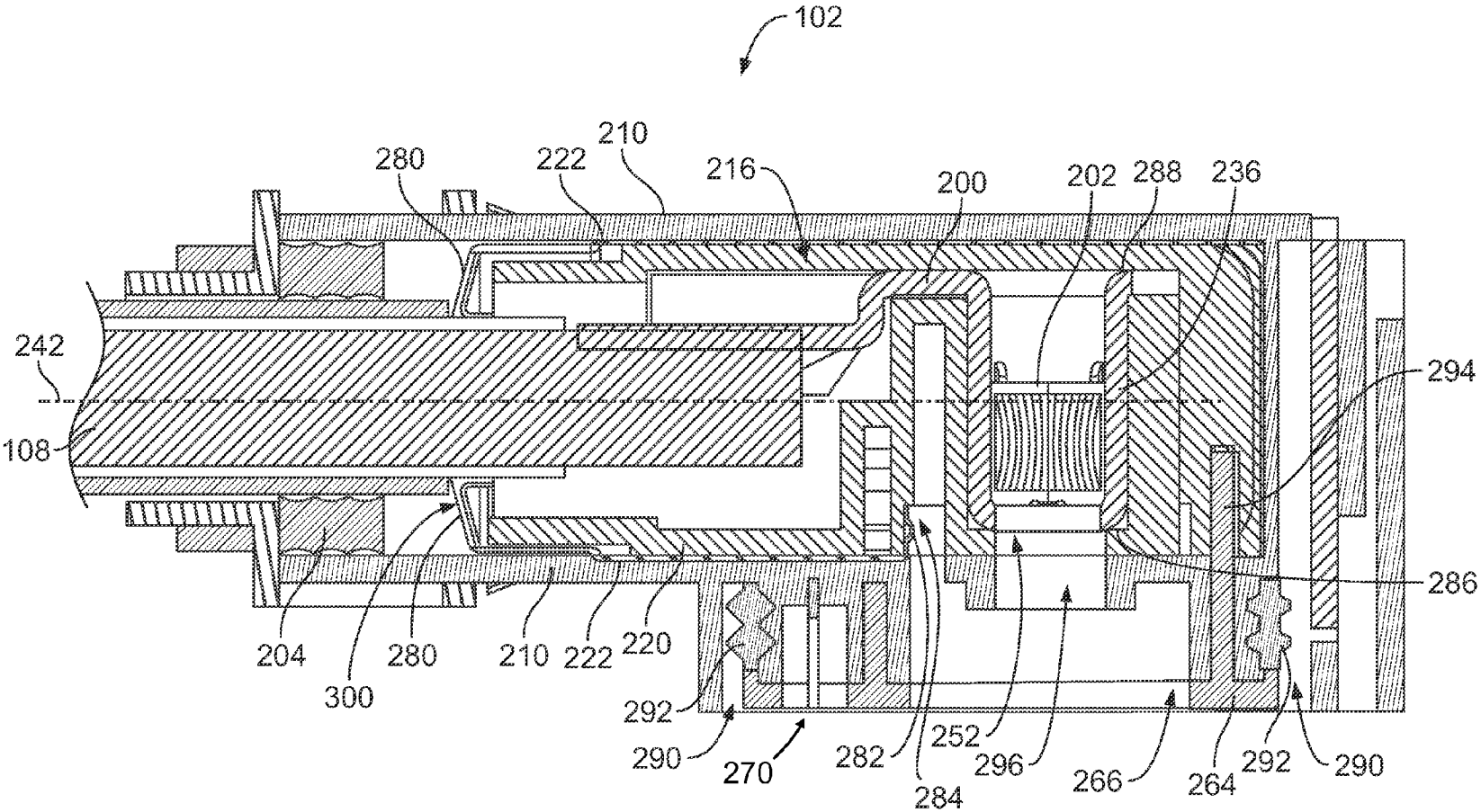
FIG. 5 is a cross-sectional view of the power terminal connector terminated to a cable.

FIG. 5 is a cross-sectional view of the power terminal connector 102 terminated to the cable 108. The terminal body 200 is terminated to the center conductor of the cable 108. The cable seal 204 is sealed against the jacket of the cable 108 and an inner surface of the plug housing 210. The insert shield 222 is electrically connected a ferrule 300. The ferule 300 is terminated to a cable shield 280 of the cable 108. The insert shield 222 extends along, and around, the dielectric insert 216. A shield interface 282 is provided along the lower plug insert 220 at the first opening 266 through the cover 264 to interface with the shroud shield 150 (shown in FIG. 1) when the power terminal connector 102 is coupled to the header assembly 120 (shown in FIG. 1). The HVIL connector 270 is accessible through the cover 264 and held in the plug housing 210.

A channel 284 is provided in the lower plug insert 220 that receives the inner shroud 128 (shown in FIG. 1) when the power terminal connector 102 is coupled to the header assembly 120. The channel 284 is aligned with the first opening 266 and the cover 264. The opening 252 is also exposed within the first opening 266 of the cover 264. The socket 236 of the terminal body 200 and the contact spring 202 are aligned with the opening 252 to receive the pin 124 therein. A bottom 286 of the socket 236 and a top 288 of the socket 236 are provided on opposite sides of the cable 108. The socket 236 is positioned such that the socket 236 is approximately axially aligned with the central axis 242 of the center conductor of the cable 108.

An outer channel 290 is provided radially outward of the channel 284. The outer channel 290 is provided in the plug housing 210. The outer channel 290 is configured to receive the outer shroud 130 (shown in FIG. 1) of the header assembly 120. A seal 292 is provided within the plug housing 210 at the outer channel 290. The seal 292 provides a sealing interface between the plug housing 210 and the header assembly 120.

The cover 264 includes an extension 294 that extends into the lower plug insert 220. The extension 294 orients or positions the cover 264 with respect to the dielectric insert 216. Orienting the cover 264 with respect to the dielectric insert 216 provides position assurance that the first opening 266 is aligned with the opening 252, the terminal body 200, the contact spring 202 and the channel 284. The extension 294 extends through the plug housing 210 to ensure that the plug housing 210 is aligned with respect to the dielectric insert 216.

In an exemplary embodiment, the plug housing 210 includes an opening 296 aligned with the opening 252 in the lower plug insert 220. The opening 296 provides access to the terminal body 200 for loading the pin 124 into the terminal body 200. The opening 296 is narrow and strong enough to pass a touch safe test. The material of the plug housing 210 surrounding the opening 296 ensures that a test tool is incapable of touching the terminal body 200.

A touch safe power terminal connector 102 and header assembly 120 are thus provided having touch safe features that restrict access to current carrying components of the power terminal connector 102 and the header assembly 120. The terminal body 200 is surrounded by the dielectric insert 216 of the insert assembly 214. The insert shield 218 provides electromagnetic shielding for the terminal body 200. The plug housing 210 surrounds the insert shield 218 and the terminal body 200 to ensure that the insert shield 218 and the terminal body 200 cannot be touched by a user or tool. The header assembly 120 includes the inner shroud 128 surrounding the pin 124 to ensure that the pin 124 cannot be touched by a user or tool. The inner shroud 128 is positioned between the shroud shield 150 and the pin 124 to ensure that the shroud shield 150 and the pin 124 do not contact one another. The inner shroud 128 may have the slots 154 that receive the ribs 254 to orient the power terminal connector 102 with respect to the header assembly 120. A robust connector system is provided having an efficient number of parts and a simple design. The connector system has a low profile and a small size.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A power connector system comprising:

a header assembly including a conductive pin, an inner shroud surrounding the pin, and an outer shroud surrounding the inner shroud, the inner shroud having slots therethrough; and a power terminal connector including a plug housing having a cavity and an insert assembly received in the cavity, the insert assembly having a terminal body configured to be terminated to an end of a conductor of a power cable, the terminal body having a mating end for mating with and being electrically connected to the pin of the header assembly, the insert assembly having a dielectric insert holding the terminal body and encasing the mating end of the terminal body, and the insert assembly having an insert shield surrounding the dielectric insert and providing shielding for the terminal body, the dielectric insert having ribs configured to be received in corresponding slots to orient the power terminal connector with respect to the header assembly.

2. The power connector system of claim 1, wherein the inner shroud is spaced apart from and radially surrounds the pin and the outer shroud is spaced apart from and radially surrounds the inner shroud.

3. The power connector system of claim 1, wherein an inner gap is defined between the pin and the inner shroud, the inner gap being narrow enough to pass a touch safe test.

4. The power connector system of claim 1, wherein an inner gap is defined between the pin and inner shroud, an outer gap being defined between the inner shroud and the outer shroud, the inner gap receiving the terminal body, the outer gap receiving the dielectric insert, the plug housing surrounding the outer shroud.

5. The power connector system of claim 1, wherein the header assembly includes a high voltage interlock (HVIL) connector positioned inside the outer shroud, the inner shroud being positioned between the HVIL and the pin.

6. The power connector system of claim 5, further comprising a shroud shield surrounding the inner shroud, the shroud shield being positioned between the inner shroud and the HVIL.

7. The power connector system of claim 1, wherein the header assembly comprises a shroud shield circumferentially surrounding the inner shroud, the inner shroud being positioned between the shroud shield and the pin, the insert shield engaging the shroud shield.

8. The power connector system of claim 1, wherein the pin includes an insulative cap at a distal end of the pin, the insulative cap being axially aligned with a top of the inner shroud.

9. The power connector system of claim 1, wherein the header assembly includes a base, the inner shroud, outer shroud and base being co-molded and integrally formed, the pin extending axially upward from the base, the inner shroud and outer shroud being positioned radially outward from the pin.

10. The power connector system of claim 1, wherein the inner shroud has an open top, the terminal body being loaded into the inner shroud through the open top to engage the pin, and wherein the outer shroud has an open top and an open side, the dielectric insert being loaded into the outer shroud through the open top, the plug housing extending from the outer shroud through the open side.

11. The power connector system of claim 1, wherein the plug housing engages the insert assembly and includes an opening providing access to the terminal body for mating with the pin, the opening being narrow enough to pass a touch safe test.

12. The power connector system of claim 1, wherein the dielectric insert includes an upper plug insert and a lower plug insert coupled to the upper plug insert, the terminal body being captured between the upper and lower plug inserts.

13. The power connector system of claim 1, wherein the terminal body includes a mating end and a mounting end extending generally perpendicular with respect to the mating end, the mating end being cylindrical and receiving the pin therein, a contact spring being disposed in the mating end to engage the pin and the terminal body.

14. The power connector system of claim 1, wherein the terminal body includes a mating portion and a mounting portion extending generally perpendicular with respect to the mating portion, the mating portion extending axially between a top and a bottom, a center of the mating portion being approximately axially aligned with a central axis of the conductor.

15. The power connector system of claim 1, wherein the terminal body includes a contact spring therein that engages the pin, the terminal body being positioned and shaped to receive the contact spring such that the interface between the contact spring and the pin is approximately axially aligned with a central axis of the conductor.

16. A power connector system comprising:

a header assembly including a conductive pin, an inner shroud surrounding the pin, and an outer shroud surrounding the inner shroud; and a power terminal connector comprising:

a plug housing having a cavity; and an insert assembly received in the cavity, the insert assembly having a terminal body configured to be terminated to an end of a conductor of a power cable and being electrically connected to the pin of the header assembly, the insert assembly having a dielectric insert holding the terminal body, and the insert assembly having an insert shield surrounding the dielectric insert and providing shielding for the terminal body, the dielectric insert having an upper plug insert and a lower plug insert coupled to the upper plug insert, the terminal body being captured between the upper and lower plug inserts.

17. The power connector system of claim 16, wherein an inner gap is defined between the pin and the inner shroud, the inner gap being narrow enough to pass a touch safe test.

18. The power connector system of claim 16, wherein the header assembly includes a high voltage interlock (HVIL) connector positioned inside the outer shroud, the inner shroud being positioned between the HVIL and the pin, a shroud shield surrounding the inner shroud and being positioned between the inner shroud and the HVIL.

19. The power connector system of claim 16, wherein the header assembly comprises a shroud shield circumferentially surrounding the inner shroud, the inner shroud being positioned between the shroud shield and the pin, the insert shield engaging the shroud shield.

20. A power connector system comprising:

a power terminal connector configured to be electrically connected to a header assembly, the power terminal connector comprising a plug housing having a cavity and an insert assembly received in the cavity, the insert assembly having a terminal body configured to be terminated to an end of a conductor of a power cable and configured to be electrically connected to the pin of the header assembly, the insert assembly having a dielectric insert holding the terminal body, and the insert assembly having an insert shield surrounding the dielectric insert and providing shielding for the terminal body, the dielectric insert having an upper plug insert and a lower plug insert coupled to the upper plug insert, the upper and lower plug inserts completely surrounding the terminal body along an entire length of the terminal body such that the terminal body is captured between the upper and lower plug inserts, the lower plug insert having an opening to receive the pin of the header assembly.

* * * * *